United States Patent [19]

Tucker

[11] 4,103,390

[45] Aug. 1, 1978

[54] SLASHER VACUUM CLEANING SYSTEM

[75] Inventor: Samuel M. Tucker, Rome, Ga.

[73] Assignees: John C. Robinson; Wade H. Youngblood; Harry H. Briscoe, all of Rome, Ga. ; part interest to each

[21] Appl. No.: 752,450

[22] Filed: Dec. 20, 1976

[51] Int. Cl.[2] ..... A47L 5/38

[52] U.S. Cl. ..... 28/173; 15/339; 15/306 A

[58] Field of Search ..... 15/306 R, 306 A, 306 B, 15/308, 312 A, 354, 301, 339; 28/55.3, 72.5

[56] References Cited

U.S. PATENT DOCUMENTS

| | | | |
|---|---|---|---|
| 2,875,846 | 3/1959 | Yonkers | 15/306 A X |
| 2,934,797 | 3/1960 | Whitehurst et al. | 15/306 R X |
| 3,003,178 | 10/1961 | McEachern | 15/312 A |
| 3,112,601 | 12/1963 | McCullough | 15/312 A X |
| 3,751,756 | 8/1973 | Arnett, Jr. | 15/306 A |

FOREIGN PATENT DOCUMENTS

| | | | |
|---|---|---|---|
| 1,375,293 | 9/1964 | France | 15/312 A |

*Primary Examiner*—Christopher K. Moore
*Attorney, Agent, or Firm*—Newton, Hopkins & Ormsby

[57] ABSTRACT

Dual vacuum cleaing heads are provided above the sheet of warp yarns at opposite ends of a slasher intake portion where the multiple section beams are mounted on a creel ahead of the sizing bath. The two suction heads thoroughly remove debris from the sheet of warps at two locations before the sheet enters the sizing bath. The suction heads are suspended by transparent vacuum hoses from overhead serially connected vacuum manifolds. One manifold is connected with a centrifugal fan which evacuates both manifolds and delivers debris to a collection tank immediately ahead of the fan and having a filter. Viewing windows and clean-out ports are provided in the system.

10 Claims, 5 Drawing Figures

SLASHER VACUUM CLEANING SYSTEM

BACKGROUND OF THE INVENTION

A need exists for a means to rid the sheet of warp yarns in a slasher of foreign matter including lint, string and other debris prior to passage of the warp sheet into the sizing tank of the slasher downstream from the creel on which several section beams of warp yarns are supported.

The objective of the invention is to satisfy this need of the art through provision of a simple, economical and efficient vacuum cleaning system for the creel or inlet section of a slasher upstream from the sizing bath, so that the sheet of warp yarns is subjected to two vacuum cleaning operations before entering the sizing tank of the slasher.

Some examples of the patented prior art relating to cleaning systems for textile machinery and disclosed in U.S. Pat. Nos. 2,840,861; 2,835,103 and 3,267,970. These patented systems are not adaptable to the creel section of a slasher and if employed would tend to interfere with the duties of the slasher operator or attendant. In this connection, a feature of the invention is that the vacuum cleaning system on the creel section of the slasher does not interfere with the operation or efficiency of the slahser and does not hinder the slasher attendant in his routine duties. The invention is characterized by extreme simplicity and minimum maintenance requirement.

SUMMARY OF THE INVENTION

A pair of vacuum heads or beams is suspended by preferably transparent reinforced flexible vacuum hoses from a pair of fixed overhead vacuum manifolds, at least one of which is connected to a strong suction fan. The suction heads are transverse to the line of movement of a sheet of warp yarns at the creel or inlet section of the slasher. The two overhead manifolds are serially connected by ducting along one side of the creel. Viewing windows and clean-out ports are provided in the system. The suction fan delivers the debris taken from the sheet of warp yarn into a collection tank having a filter.

DETAILED DESCRIPTION

Figure 1:
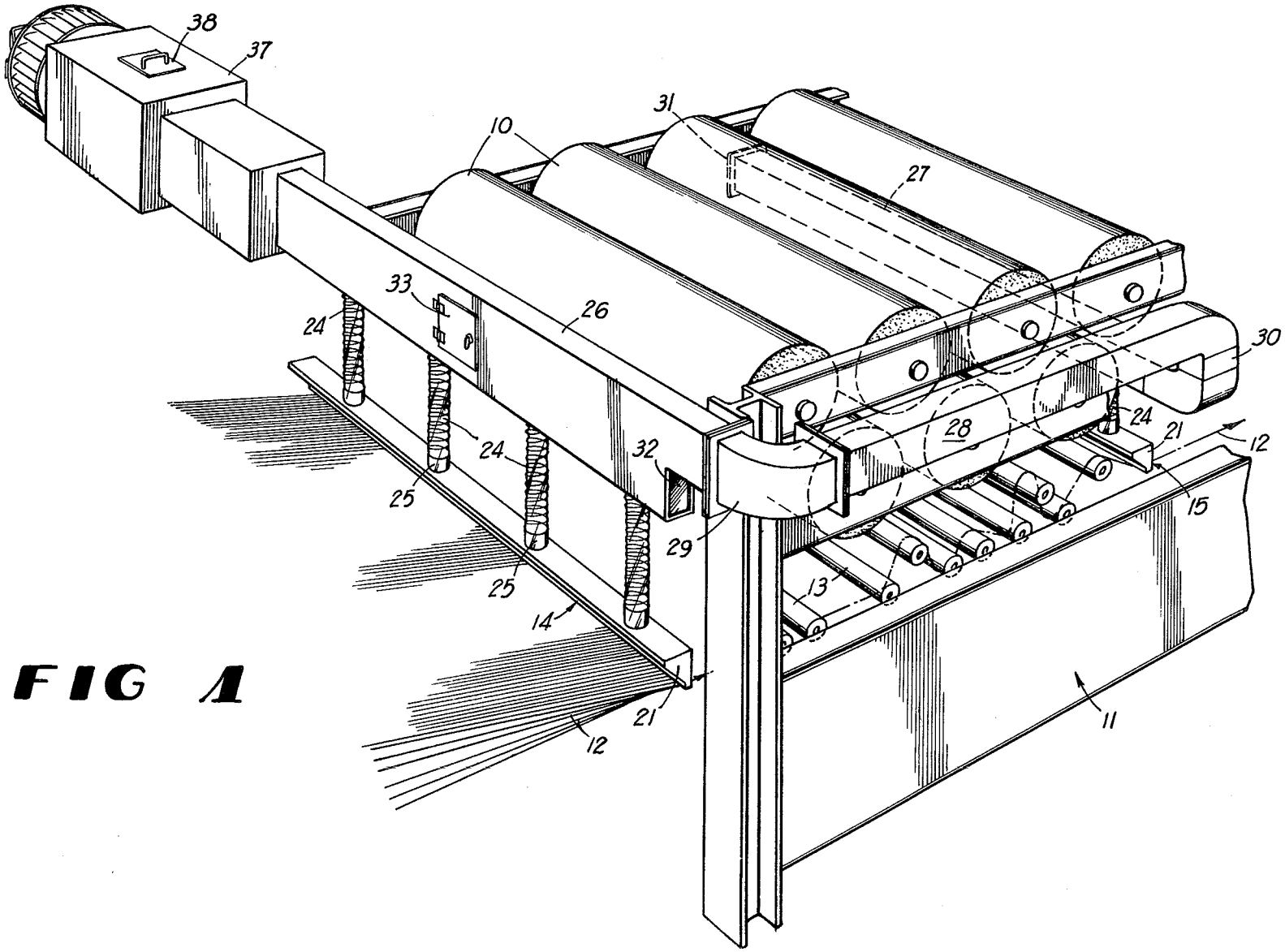
FIG. 1 is a perspective view of the invention as applied to the creel section of a slasher.

Referring to the drawings in detail, wherein like numerals designate like parts, FIG. 1 illustrates the creel end of a slasher wherein several section beams 10 of warp yarns are supported on a creel 11, upstream from a sizing bath, not shown, where a proper sizing is applied to a sheet 12 of warps taken from the section beams 10 and passed through the slasher. After the warp sheet 12 is formed in the slasher, this sheet passes through the sizing bath, not shown, and then to a drying drum and, finally, the sized and dried warp yarns are wound on a loom beam suitable for use in a loom. The invention herein is concerned with providing a vacuum cleaning system for the sheet of warps 12 at two locations on the creel section of the slasher. The first vacuum cleaning of the sheet of warps 12 takes place at the inlet of the creel 11 immediately before the warp sheet enters the roller system 13. The second vacuum cleaning operation takes place at the downstream end of the creel 11, immediately ahead of the sizing tank, not shown.

The vacuum cleaning system proper forming the subject matter of the invention is an attachment to the conventional slasher and comprises primary and secondary suction beams or heads 14 and 15 at the mentioned two vacuum cleaning locations on the creel. Each suction head spans the warp sheet 12 transversely to thoroughly clean the full width of the sheet by removing lint, loose strings and other foreign matter. This cleaning operation reduces breakage of the individual yarn fibers in the slasher and otherwise renders the yarn suitable for the subsequent weaving operation.

Figure 4:
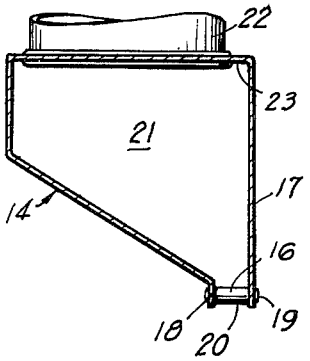
FIG. 4 is an enlarged transverse vertical section taken on line 4—4 of FIG. 3.
Figure 5:
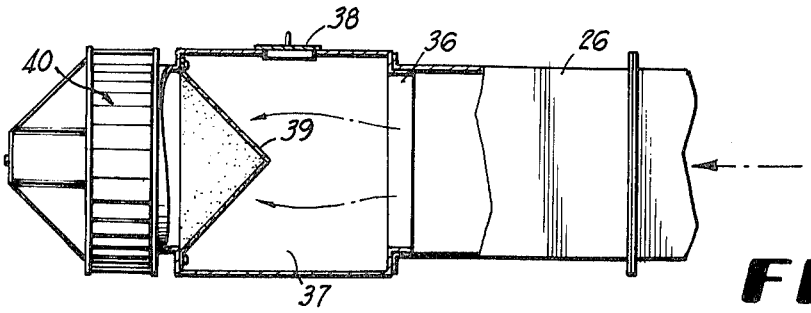
FIG. 5 is a side elevational view, partly in section, showing a suction fan and debris collection tank with the filter taken on line 5—5 of FIG. 2.

Each suction head 14 and 15 is an elongated downwardly tapering hollow sheet metal structure of box formation having a restricted width longitudinal suction slot 16 at its bottom, extending continuously for the full length of the suction head. In practice, the width of the slot 16 may be of the order of three-fourths of an inch but the dimension is not critical. The two walls 17 and 18 which define the mouth or slot 16 of each suction head are joined by through bolts 19 with stabilizing spacers 20 surrounding the bolts, see FIG. 4. Preferably, one end wall 21 of each suction head 14 and 15 is of transparent material so that the slasher attendant can periodically view the interior of the system.

Figure 3:
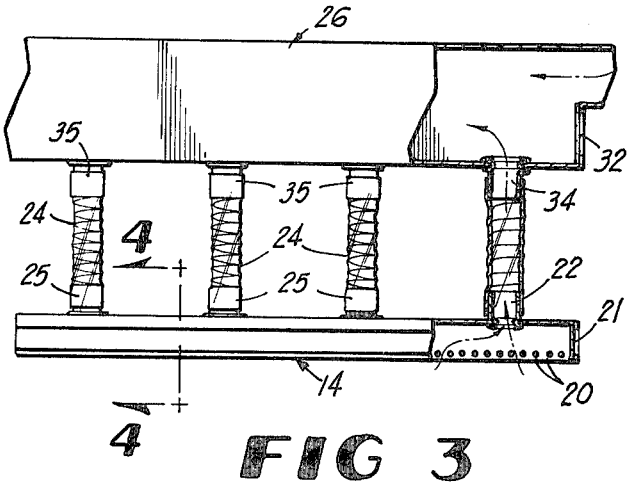
FIG. 3 is a fragmentary elevational view, partly in section, taken on line 3—3 of FIG. 2.

Each suction head 14 and 15 has preferably four equidistantly spaced tubular nipples 22 connected in its horizontal top wall 23 in an air-tight manner to assure substantially equal distribution of suction pressure across the entire head 14 or 15. A corresponding number of preferably transparent flexible reinforced suction tubes 24 have their lower ends 25 telescopically coupled with the nipples 22, FIG. 3, and these flexible tubes serve to floatingly suspend each head 14 or 15 slightly above the sheet 12 of warp yarns during the operation of the system. Ideally, the suction inlet slot 16 of the head 14 or 15 is held about one-eighth of an inch above the warp sheet 12 at both cleaning locations where the heads 14 and 15 are located.

Figure 2:
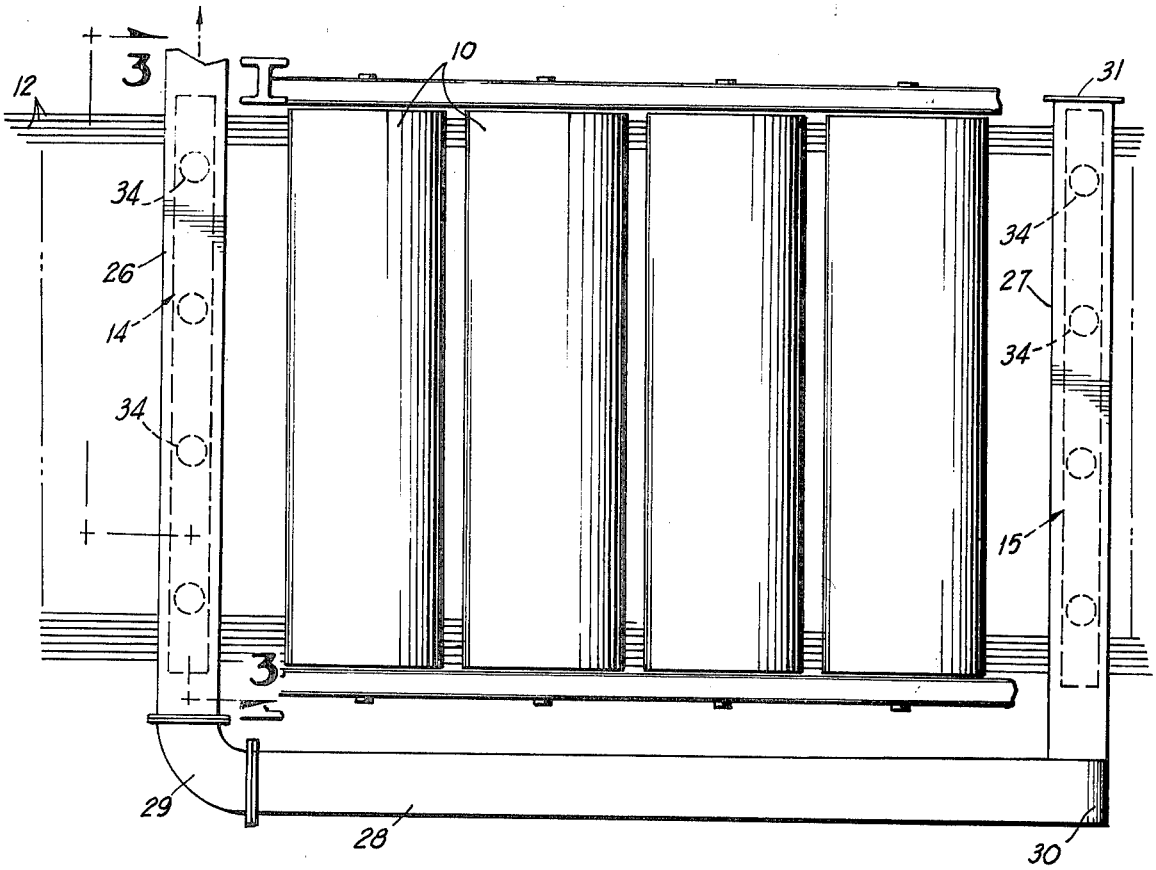
FIG. 2 is a plan view of the invention in relation to the slasher.

Primary and secondary manifolds 26 and 27 are located above and parallel to the primary and secondary suction heads 14 and 15. Corresponding ends of the two manifolds 26 and 27 are joined in series by a longitudinal duct 28 extending along and close to one side of the creel 11 near the elevation of the suction beams 10. A horizontal elbow 29 joins the duct 28 with the manifold 26, and a compound elbow 30 joins the duct 28 with the secondary manifold 27. The far end of manifold 27, FIG. 2, preferably has a transparent viewing window 31 serving to close the far end. A similar transparent veiwing window 32 is provided in the opposite end of manifold 26, as shown in FIG. 1. The manifold 26 has a clean-out door 33 near its longitudinal center, as shown.

The two manifolds 26 and 27 carry depending tubular nipples 34 on their bottoms and the top ends 35 of the suction head suspension tube 24 are telescopically engaged over these nipples and securely clamped. Consequently, the two suction heads 14 and 15 hang from the supported manifolds 26 and 27 through the flexible tubes 24 which collectively are quite strong. The suction tubes are preferably about 4 inch in diameter and, again, the stated dimensions are not critical and are merely illustrative of a practical embodiment of the invention. The manifolds 26 and 27 and the duct 28 connecting them in series are mounted on the creel structure by any suitable bracket means, not shown.

The end of primary suction manifold 26 away from the elbow 27 is coupled as at 36 with a lint collection tank 37 having a top clean-out door 38 and a renewable lint filter 39 of conical form. All lint, strings and other debris enter the tank 37 from the manifold 26 and this debris is trapped in the tank and because of the filter 39 cannot pass with the airstream into the high capacity centrifugal suction fan 40 which is coupled to the tank 37 immediately beyond the filter 39. This fan draws sufficient vacuum in the system to create enough suction at the intake slots 16 of both suction heads 14 and 15 to subject the warp sheet 12 to an efficient vacuum cleaning across its entire width and oppposite ends of the creel 11, so that the sheet of warps is substantially free of debris when entering the sizing bath beyond the creel. The lint and debris picked up by both heads 14 and 15 is delivered through the transparent suspension tubes 24 to the respective manifolds 26 and 27 and from these manifolds, the debris is drawn by the fan 40 into the collection tank 37. It may be seen that the simple system embodies only four main parts, namely, suction heads 14 and 15, overhead manifolds 26 and 27, collection tank 37 and suction fan 40. The system is efficient, comparatively low cost, and does not adversely effect the operation of the slasher or impede the work of the slasher attendant. The advantages of the system should be apparent to those skilled in the art.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A vacuum cleaning system for the creel portion of a slasher adapted to vacuum clean a sheet of warps at two points near opposite ends of the creel section before the sheet of warps enters a sizing bath of the slasher, said system comprising a pair of suction heads extending transversely across the sheet of warps the suction heads having downwardly open intake slots arranged close to the top of the sheet warps and spanning the entire sheet of warps, a pair of fixed overhead suction manifolds above said suction heads, each manifold being associated with a given suction head, one of said suction heads being located near the upstream end of the creel and the other said suction head being located near the downstream end of the creel, plural spaced substantially vertical tubes coupled between the suction heads and the manifolds and carrying the suction heads, the interiors of the suction heads and manifolds being in fluid communication with said tubes, conduit means connecting said manifolds serially, and a vacuum producer connected with one manifold.

2. A vacuum cleaning system as defined in claim 1, and said tubes comprising transparent flexible tubes which floatingly suspend said suction heads from said fixed manifolds.

3. a vacuum cleaning system as defined in claim 1, and said manifolds extending transversely of the creel section near its opposite ends, and said conduit means including a length of conduit extending longitudinally of the creel section outwardly of one side thereof and being connected by elbows with corresponding ends of said manifolds.

4. A vacuum cleaning system as defined in claim 1, and said vacuum producer comprising a suction fan connected to the end of one manifold remote from said conduit means.

5. A vacuum cleaning system as defined in claim 4, and a debris collection tank located in said one manifold immediately ahead of said suction fan, and a filter positioned between the debris collection tank and said suction fan.

6. A vacuum cleaning system as defined in claim 1, and said suction heads and overhead suction manifolds having transparent viewing windows.

7. A vacuum cleaning system for the creel portion of a slasher comprising a suction source, suction manifolds mounted near opposite ends of the creel above a sheet of warps passing into the slasher, a pair of suction cleaning heads, each suction head being suspended by a plurality of tubes from its associated manifold and extending transversely across the sheet of warps in close proximity to the top of the sheet, said suction source being in fluid communication with said manifolds and through said pluralities of tubes, with said suction heads.

8. A vacuum cleaning system as defined in claim 7, and conduit means serially connecting said manifolds, and a source of suction connected with at least one manifold.

9. A vacuum cleaning system for the creel section of a slasher adapted to vacuum clean a sheet of warps at two points, one near the upstream end and one near the downstream end of said creel section, said vacuum cleaning system comprising a source of suction, a pair of suction heads extending substantially completely transversely across said sheet of warps, one said suction head being located at each of said points, and positioned on one side of the sheet of warps in close proximity thereto, each suction head having a substantially continuous longitudinal suction slot facing the sheet of warps and spanning the sheet transversely for substantially the entire transverse width of the sheet of warps, a suction manifold means for assisting in communicating said suction source with said suction heads, said manifold means being spaced substantially from said one side of the sheet of warps, and from said pair of suction heads, each of said suction heads being solely mechanically connected to said manifold means by a corresponding plurality of suction tubes, the interiors of the suction heads being in fluid communication with said manifold means through said pluralities of suction tubes.

10. In a slasher, a creel section having a system of transverse rollers for guidance of a sheet of warps at one elevation and a plurality of warp beams at another elevation spaced a substantial distance from said system of rollers, a suction manifold disposed substantially at said another elevation adjacent to said warp beams and including two manifold sections extending transversely of the sheet of warps near the upstream and downstream ends of the creel section, a suction producer connected with said suction manifold, a pair of suction heads spaced from said two manifold sections in substantial vertical alignment therewith and disposed on one side of said sheet of warps in close proximity thereto at two points one near the upstream end and one near the downstream end of said creel section, each suction head having a longitudinal suction slot facing the sheet of warps and extending substantially completely across the sheet transversely and substantially parallel to said rollers, and said suction heads each being coupled to a respective manifold section by a plurality of suction tubes, the interiors of the suction heads and two manifold sections being in fluid communication through said suction tubes.

* * * * *